United States Patent [19]

Ikuta et al.

[11] Patent Number: 4,621,687

[45] Date of Patent: Nov. 11, 1986

[54] FLAT TUBE HEAT EXCHANGER HAVING CORRUGATED FINS WITH LOUVERS

[75] Inventors: Shiro Ikuta, Tokyo; Koji Homma, Sano, both of Japan

[73] Assignee: Nihon Radiator Co., Ltd., Tokyo, Japan

[21] Appl. No.: 659,651

[22] Filed: Oct. 11, 1984

[51] Int. Cl.[4] ..... F28F 1/22

[52] U.S. Cl. ..... 165/152

[58] Field of Search ..... 165/151, 152, 153

[56] References Cited

U.S. PATENT DOCUMENTS

| | | | |
|---|---|---|---|
| 1,416,570 | 5/1922 | Modine | 165/151 |
| 3,003,749 | 10/1961 | Morse | 165/152 |
| 3,265,127 | 8/1966 | Nickol et al. | 165/152 |
| 3,796,258 | 3/1974 | Malhorta et al. | 165/151 |
| 4,469,167 | 9/1984 | Itoh et al. | 165/151 |

FOREIGN PATENT DOCUMENTS

| | | | |
|---|---|---|---|
| 472122 | 11/1914 | France | 165/151 |
| 1521499 | 4/1968 | France | 165/151 |
| 155391 | 12/1981 | Japan | 165/151 |
| 444890 | 3/1936 | United Kingdom | 165/151 |

*Primary Examiner*—Sheldon J. Richter

*Attorney, Agent, or Firm*—Gordon W. Hueschen

[57] ABSTRACT

A heat exchanger having corrugated fins interposed between adjacent folds of a liquid tube, which corrugated fins severally contain in each of the holds thereof a louver having louver blades alternately projected from the base line of fin and having at least part of said louver blades so arranged that the states of inclination thereof relative to said base line of fin vary alternately.

14 Claims, 9 Drawing Figures

FLAT TUBE HEAT EXCHANGER HAVING CORRUGATED FINS WITH LOUVERS

BACKGROUND OF THE INVENTION

1. Field of the Invention

This invention relates to a heat exchanger. More particularly, this invention relates to a heat exchanger provided with improved corrugated fins and intended mainly for use in automobiles.

2. Description of Prior Art

The heat exchangers (evaporators, condensers, heaters, etc.) in automotive air-conditioner systems and the heat exchangers such as automotive radiators preponderantly come in a fin-and-tube type having corrugated fins interposed one each between the adjacent folds of tubes, a laminate type having a multiplicity of tray-shaped plates laminating one over another so as to give rise to tubes for passage of coolant and having corrugated fins interposed one each between the adjacent tubes, and a serpentine type having corrugated fins interposed one each between the adjacent folds of a flat tube which has been extrusion molded so as to contain therein a multiplicity of holes for passage of coolant.

FIG. 1 is a cross sectional view illustrating a typical heat exchanger of the laminate type. This heat exchanger 1 has tray-shaped plates (pieces) 2 joined in pairs along their peripheral flanges 3 after the fashion of the shell of a cream puff to form therein a tube unit 5 incorporating a passage 4 for heat transfer medium 4, a plurality of such tube units 5 superposed one over another to give rise to empty spaces 6 therebetween, and corrugated fins 7 disposed one each in such empty spaces 6. The coolant which is introduced via an inlet side conduit 8, passed through the interiors of the tube units 5, and discharged via an outlet side conduit 9 exchanges heat with the air which is flowing along the fins 7.

A heat exchanger of the serpentine type is constructed as illustrated in FIG. 2. This evaporator 11 is formed by winding flat tubes 14 possessing a multiplicity of holes 13 for passage of heat transfer medium and disposing corrugated fins 15 one each in the empty spaces occurring between the adjacent folds of the tube 14. The heat transfer medium which is admitted via an inlet side conduit 16, passed through the interior of the tube 14, and discharged via an outlet side conduit 17 exchanges heat with the air which is flowing along the fins 15.

FIG. 3 is a perspective view illustrating part of the heat exchanger of FIG. 2 as magnified. A corrugated fin 15 is provided in each of the folds thereof with a louver 18 as illustrated in FIG. 3. In a similar corrugated fin used in other types of heat exchangers, a similar louver is formed in each of the folds. The formation of such louvers 18 in the corrugated fins 15 is intended to enhance the overall heat transfer coefficient of the corrugated fins by enabling the louvers to manifest an edge effect without necessitating any change in the overall surface area of the corrugated fins including louvers.

It will be observed that in each FIGS. 1, 2, and 3, the liquid tubes are arranged to have a plurality of flat, parallel radiating surfaces and that the corrugated fins have U-shaped bends juxtaposed to and in heat contact with these radiating surfaces.

The louver in each fold of the corrugated fin may be of the type having the blades thereof alternately projected from the base plane A of the fin and arranged parallelly to the base plane A as illustrated in FIG. 4, the type having the blades similarly projected from the base plane and slanted by a fixed angle relative to the flow of wind (indicated by the arrow) as illustrated in FIG. 5, or the type having a first half group of blades divergently slanted at a fixed angle and a last half group of blades convergently slanted at a fixed angle relative to the flow of wind as disclosed in U.S. Pat. No. 3,250,325, for example.

In the case of the louver of FIG. 4, however, if the interval d between the adjacent louver blades is small, the air flow boundary layer (indicated by dotted lines) for the first louver blade $l_1$ grows so much as to cover completely the second louver blade $l_2$ and lower the heat transfer coefficient of the second louver blade $l_2$. The degree of the loss of heat transfer coefficient decreases in proportion as the interval d increases. When the width w of the louver blades is decreased for the purpose of enhancing the efficiency of the corrugated fin, the interval d mentioned above is inevitably decreased proportionally. As the result, the loss of heat transfer coefficient in the second and following louver blades is increasd possibly to a point where the improvement in the so-called louver effect can no longer be expected.

In contrast, the louver of FIG. 5 and the louver of the aformentioned U.S. patent have substantially no effect of the air boundary layer and prove advantageous in terms of heat transfer coeffieient. The flow of air entering these louvers, however, is bent by the louver blades in the directions indicated by the arrows while passing between the adjacent corrugated fins. In these louvers, the louver blades function as resisting objects to the flow of air. The heat exchanger using such corrugated fins as incorporating such louvers, therefore, offers large resistance to the flow of air and low heat exchange efficiency.

An object of this invention, therefore, is to provide an improved heat exchanger.

Another object of this invention is to provide a heat exchanger provided with corrugated fins which are free from the effect of air flow boundary layer and offers no appreciable resistance to the flow of air.

SUMMARY OF THE INVENTION

The objects described above are attained by a heat exchanger having corrugated fins interposed between adjacent folds of liquid tubes, which corrugated fins severally contain in each of the folds thereof at a louver having louver blades alternately projected from the base plane of the fins and having at least part of the louver blades so arranged that their states of inclination relative to the base plane of the fins vary alternately.

DESCRIPTION OF THE PREFERRED EMBODIMENT

Figure 1:
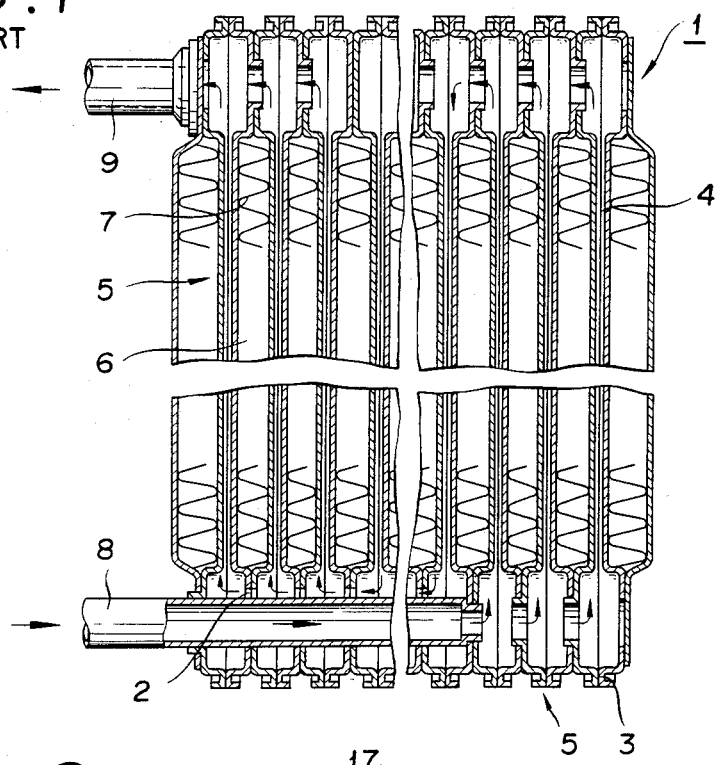
FIG. 1 PRIOR ART
FIG. 1 is a cross sectional view of a heat exchanger of a laminate type.
Figure 2:
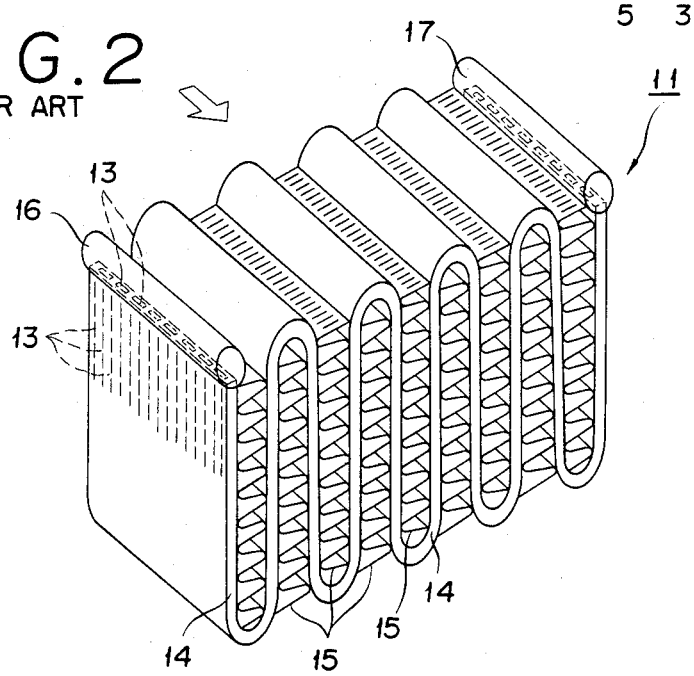
FIG. 2 PRIOR ART
FIG. 2 is a perspective view of a heat exchanger of a serpentine type.
Figure 3:
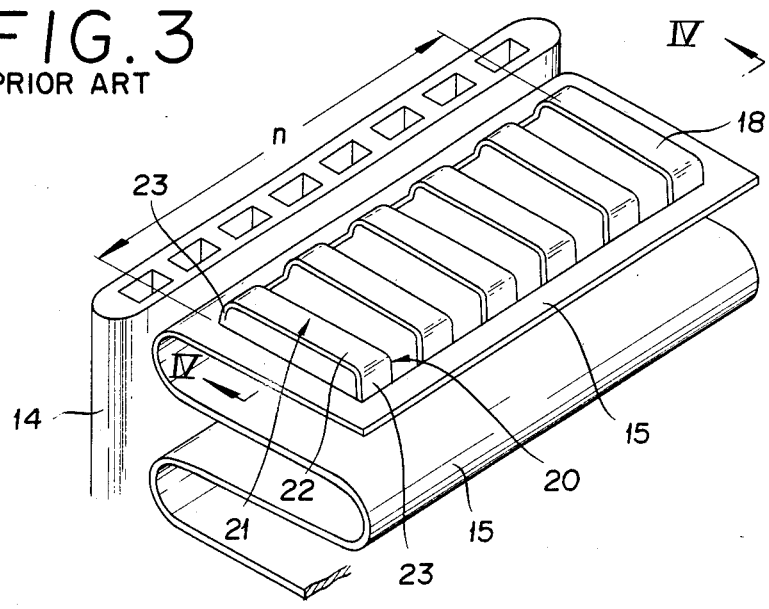
FIG. 3 PRIOR ART
FIG. 3 is a magnified prospective view of the essential part of the heat exchanger of FIG. 2.
Figure 4:
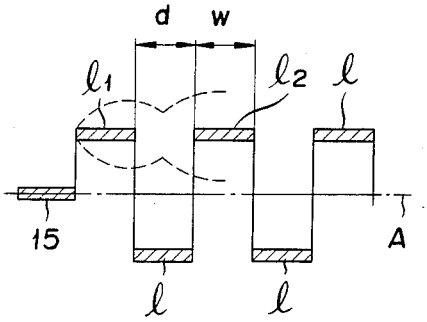
FIG. 4 PRIOR ART
FIG. 4 is a cross sectional view taken along the line IV—IV in the diagram of FIG. 3.
Figure 5:
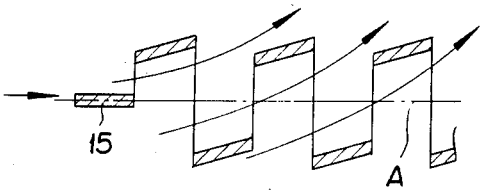
FIG. 5 PRIOR ART
FIG. 5 is a cross sectional view similar to the diagram of FIG. 4.
Figure 6:
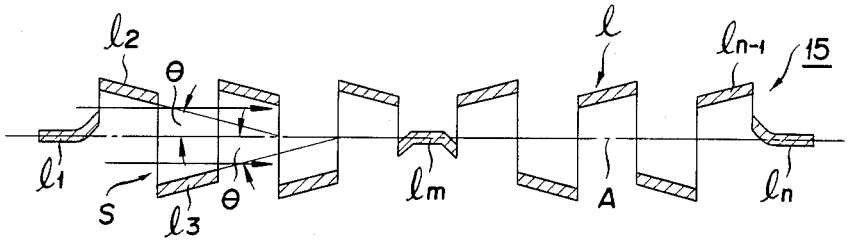
FIG. 6 is a cross sectional view illustrating a louver construction in the corrugated fins used in a heat exchanger of the present invention.

Now, one embodiment of the present invention will be described below with reference to the accompanying drawings. FIG. 6 represents a cross sectional view illustrating a louver in the corrugated fin incorporated in a heat exchanger contemplated by the present invention. The component parts identical to those illustrated in FIG. 1 through FIG. 5 are denoted by like symbols.

A fold of the corrugated fin 15 contains a louver having a multiplicity of louver blades $l_1$, $l_2$, projected in alternately opposite directions relative to the base plane A of the fin. These louver blades $l_1$, $l_2$, are so constructed that their angles of inclination relative to the base plane A of the fin will alterrnately change in direction. The louver blades thus arranged (spaced above and below the base plane to provide an unobstructed line of sight above and below the base plane) enable the incoming flow of air (indicated by the arrow) to advance in a parallel current relative to the base plane A of the fin while keeping the direction of inflow intact.

To be more specific, the first louver blade $l_1$, which is not projected above or below the base plane, has the rear end portion thereof relative to the direction of air flow in a length of about 20 to 50%, preferably 30 to 40%, of the entire length thereof from the rear end inclined by an angle of about 5° to 10°, preferably 5° to 7°, from the remaining portion. The first louver is formed in this bent shape to acquired increased strength enough to preclude possible deformation at the end of the fold of the corrugated fin 15. This inclination poses no problem because the deformation produces substantially negligible effect as a resisting article to the flow of air.

Figure 7:
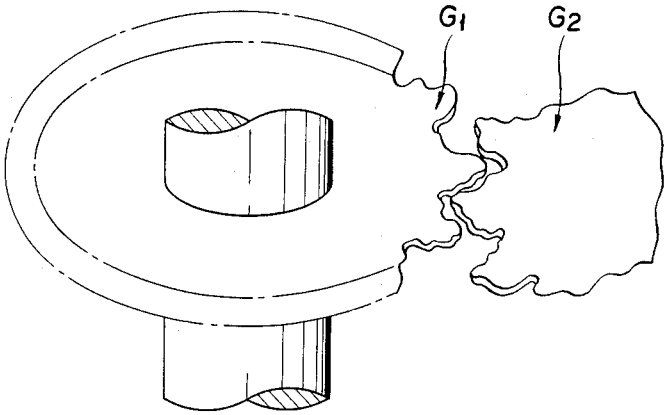
FIG. 7 is a perspective view of the essential part of a tooth-wheel cutter for the fabrication of corrugated fins.
Figure 8:
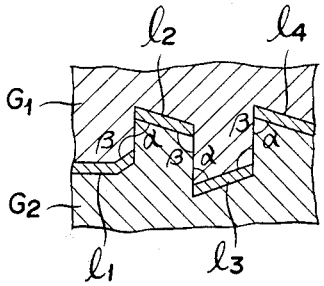
FIG. 8 is a cross sectional view illustrating the state in which corrugated fins of FIG. 6 are fabricated.

Then, the second louver blade $l_2$, which is projected above the base plane, is inclined downwardly by an angle of about 5° to about 10°, preferably 5° to 7°, relative to the base plane A of the fin and the third louver blade $l_3$, which is projected below the base plane, is inclined reversely, namely upwardly, by an angle of about 5° to about 10°, preferably 5° to 7°. Thus, the states of inclination of the successive louver blades are alternately varied. This alternation of the states of inclination is firstly aimed at providing each of the louver blades with a wide substantially equal opening S for admission of incoming air and consequently enabling the air to advance parallelly to the base plane A of the fin, though in finely zigzagging courses. Secondly it is aimed at notably enhancing the convenience of manufacture. The fabrication of a corrugated fin containing louvers is generally effected by use of toothed-wheel cutters $G_1$, $G_2$ (only one cutter blade shown for simplicity) as illustrated in FIG. 7. When louver blades are punched out in alternately opposite directions relative to the base plane A of the fin with these cutters $G_1$, $G_2$, they will be arranged as illustrated in FIG. 8.

Figure 9:
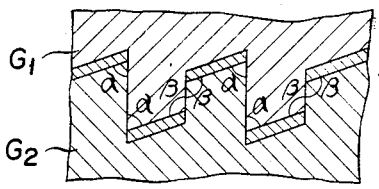
FIG. 9 PRIOR ART
FIG. 9 is a cross sectional view illustrating the state in which corrugated fins of FIG. 5 are fabricated.

During the course of the fabrication, these two cutters incise cuts in a given fin plate and raise the louver blades from the fin plate. When the edge portions which contribute to this cutting are in a combination of acute angles and obtuse angles, they offer satisfactory performance in respect that the cutting proceeds easily and the separation of the fabricated fin from the toothed-wheel cutters in obtained readily. When the angle, $\theta$, of inclination is alternately varied in direction as described above, the edge portions will be obtained in a combination of $\alpha$ and $\beta$ as illustrated in FIG. 8. For the louver construction illustrated in FIG. 5, the state of engagement of cutters is in a combination of $\alpha$ and $\alpha$ on one hand and $\beta$ and $\beta$ on the other hand as is noted clearly from FIG. 9. Evidently, this combination is inferior to that of the present invention even in terms of the convenience of fabrication.

As is noted from FIG. 6 the louver blades in the first half portion of the louver are inclined by an acute angle $\theta$ relative to the base plane A of fin and those in the last half portion are inclined by an obtuse angle, $(180°-\theta)$, in a direction departing from the base plane A of fin. Thus, the louver blades in the first half and those in the last half are symmetrical relative to the center of the entire length of the louver. The rearmost louver blade $l_n$, which is not projected above or below the base plane, is symmetrized to the first louver blade $l_1$ for the same reason as described above with respect to the first louver blade $l_1$. At the center of the louver, a louver blade $l_m$ is disposed substantially in the base plane A of fin. The opposite ends of this central louver blade $l_m$ each in a length of about 10 to 30%, preferably 15 to 25%, of the entire length thereof are inclined by the same angle as the other louver blades. The second through $(n-1)$th louver blades $l_2, l_3, \ldots l_{n-1}$ are desired to have an equal width of 0.6 to 3 mm, preferably 0.8 to 1.5 mm. The first louver blade $l_1$ and the n'th louver $l_n$ are desired to have a width of 2 to 4 mm, preferably 2 to 3 mm.

As is clear from the foregoing description, the present invention is directed to a heat exchanger having corrugated fins interposed between adjacent folds of liquid tubes, which corrugated fins severally contain in each of the folds thereof a louver having louver blades alternately projected from the base plane of fin and having at least part of the louver blades so arranged that their states of inclination relative to the base plane of the fin vary alternately. Thus, the louver offers only small resistance to the flow of air and allows the incoming air to flow substantially in a straight line. When the heat exchanger of this invention is adopted as an evaporator in the automotive air-conditioner system, it produces a current of air rich in refreshing coolness. When the corrugated fin is fabricated, the construction of this louver brings about an excelllent effect of facilitating the separation of the fabricated corrugated fin from the cutting edges.

What is claimed is:

1. In a heat exchanger having corrugated fins having a plurality of louvers connected by U-shaped bends and a liquid tube structure having a plurality of flat, parallel, radiating surfaces with the U-shaped bends of said corrugated fins juxtaposed to and in heat-transfer contact with the radiating surfaces; the improvement in which: said louvers are formed from a plurality of substantially parallel fin plates which are normal to said radiating surfaces and have juxtaposed louver-blade-forming portions alternately projected above and below the base plane of each fin plate, thereby forming a plurality of louver blades alternating above and below said base plane; at least in the front part of said louvers, said blades are so arranged that the states of inclination thereof relative to said base plane vary alternately, those above said plane sloping down toward said plane at an angle in the direction of the outlet end and those below said plane sloping up toward said plane at a like angle and in the same direction; and said louver blades have a spacial arrangement such that there are uninterrupted lines of sight from one end to the other, one line of sight being above said base plane and another line of sight being below said base plane.

2. A heat exchanger according to claim 1, wherein said angle is in the range of about 5° to about 10° and said like angle in the range of 180°-(about 5° to about 10°).

3. A heat exchanger according to claim 2, wherein the louver blades of said set of louver blades have a width of 0.6 to 3 mm.

4. A heat exchanger according to claim 1, which further comprises louver blades at the opposite ends of said set of louver blades which are in said base plane and have their inner side portions inclined relative to said base plane enough to form ribs, but not enough to block said uninterrupted lines of sight.

5. A heat exchanger according to claim 4, in which the first of the set of louver blades is above the base plane and the first of said ribs is inclined upwardly toward said first louver blade.

6. A heat exchanger according to claim 1, wherein the louver has a second set of louver blades having a symmetrical shape with respect to the first set of louver blades, said second set of louver blades being substantially a mirror image of the first set.

7. A heat exchanger according to claim 6, which further comprises louver blades at the opposite ends of said sets of louver blades which are in said base plane and have their inner side portions inclined relative to said base plane enough to form ribs, but not enough to block said uninterrupted lines of sight.

8. A heat exchanger according to claim 7, in which the first of one set of louver blades is above the base plane and the first of said ribs is inclined upwardly toward said first louver blade.

9. A heat exchanger according to claim 6, which further comprises a louver blade which is located at the center of the two sets, is in said base plane, and has its side portions inclined relative to said base plane enough to form ribs, but not enough to block said uninterrupted lines of sight.

10. A heat exchanger according to claim 9, in which the louver blade located at the center is juxtaposed to a louver blade located above the base plane and has its ribs turned downwardly away from that louver blade.

11. A heat exchanger according to claim 10, in which the last louver of the second set is above the base plane and the last rib is inclined upwardly toward that louver.

12. A heat exchanger according to claim 9, which further comprises louver blades at the opposite ends of said sets of louver blades which are in said base plane and have their inner side portions inclined relative to said base plane enough to form ribs, but not enough to block said uninterrupted lines of sight.

13. A heat exchanger according to claim 12, in which the louver blade located at the center is juxtaposed to a louver blade located above the base plane and has its ribs turned downwardly away from that louver blade.

14. A heat exchanger according to claim 13, in which the last louver of the second set is above the base plane and the last rib is inclined upwardly toward that louver.

* * * * *

UNITED STATES PATENT AND TRADEMARK OFFICE

CERTIFICATE OF CORRECTION

PATENT NO. : 4,621,687

DATED : November 11, 1986

INVENTOR(S) : Shiro Ikuta and Koji Homma

It is certified that error appears in the above-identified patent and that said Letters Patent is hereby corrected as shown below:

Title Page, [56] References Cited, U.S. PATENT DOCUMENTS, line 4; "Malhorta et al." should read -- Malhotra et al. -- (original patent)

Col. 2, line 30; "coeffieient." should read -- coefficient. --
Col. 2, line 63; "prospective" should read -- perspective --
Col. 3, line 41; "acquired" should read -- acquire --
Col. 4, line 20; before "fin" insert -- the --
Col. 4, line 22; before "fin" insert -- the --
Col. 4, line 30; before "fin" insert -- the --
Col. 4, line 44; before "fin" insert -- the --

Signed and Sealed this

Thirty-first Day of March, 1987

*Attest:*

*Attesting Officer*

DONALD J. QUIGG

*Commissioner of Patents and Trademarks*